US011408619B2

(12) United States Patent
Small, III

(10) Patent No.: US 11,408,619 B2
(45) Date of Patent: Aug. 9, 2022

(54) SUPPORT SHELF FOR AN AIR CONDITIONER EVAPORATOR COIL

(71) Applicant: Terrell Jackson Small, III, Fort Worth, TX (US)

(72) Inventor: Terrell Jackson Small, III, Fort Worth, TX (US)

( * ) Notice: Subject to any disclaimer, the term of this patent is extended or adjusted under 35 U.S.C. 154(b) by 0 days.

(21) Appl. No.: 17/099,237

(22) Filed: Nov. 16, 2020

(65) Prior Publication Data

US 2021/0148581 A1 May 20, 2021

Related U.S. Application Data

(60) Provisional application No. 62/936,554, filed on Nov. 17, 2019.

(51) Int. Cl.
*F24F 1/0063* (2019.01)
*F24F 13/30* (2006.01)
*F24F 13/20* (2006.01)

(52) U.S. Cl.
CPC ..... *F24F 1/0063* (2019.02); *F24F 13/20* (2013.01); *F24F 13/30* (2013.01)

(58) Field of Classification Search
CPC ..... F24F 1/0063; F24F 13/20; F24F 13/30; F24F 13/32; F28F 9/002; F28F 9/007
See application file for complete search history.

(56) References Cited

U.S. PATENT DOCUMENTS 3,352,126 A * 11/1967 Beshekas ..... F24F 13/30 62/286
5,207,074 A * 5/1993 Cox ..... F24F 13/30 62/285
7,601,204 B2 * 10/2009 Woodruff ..... B03C 3/017 96/30
9,851,114 B2 * 12/2017 Zinger ..... F24F 5/0071
2013/0284399 A1 * 10/2013 Yang ..... F28F 9/007 165/67

* cited by examiner

*Primary Examiner* — Joseph F Trpisovsky
(74) *Attorney, Agent, or Firm* — Guy V. Manning

(57) ABSTRACT

A universal shelf for mounting an evaporator coil into an indoor furnace cabinet includes a planar platform substantially the size of the cross section of the furnace cabinet and having attachment means along its edges, which, in one embodiment, mate with existing mounting hardware for different types of evaporator coils. At least one side edge of the platform includes a rectangular step extending at least a portion of the length of the platform, the shelf adapted to mate with a U-shaped rail attachable to the inside of the cabinet. A foldable tab on the front edge of the shelf opposite the rail attaches to the front of the cabinet while, in a preferred embodiment, a leg hingedly attached to the rear corner of the shelf opposite the rail rests upon the floor of the cabinet to hold the platform level with the rail.

15 Claims, 8 Drawing Sheets

SUPPORT SHELF FOR AN AIR CONDITIONER EVAPORATOR COIL

BE IT KNOWN that I, TERRELL JACKSON SMALL, III, a citizen of the United States of America and residing in Fort Worth, Tex., have invented new and useful improvements in a SUPPORT SHELF FOR AN AIR CONDITIONER EVAPORATOR COIL of which the following is a specification. This application claims priority from U.S. Provisional Application Ser. No. 62/936,554. filed Nov. 17, 2019.

BACKGROUND OF THE INVENTION

1. Field of the Invention

This invention relates generally to air conditioning equipment, and particularly to air conditioning equipment for mobile homes and other small structures. More particularly, this invention relates to a shelf for supporting an evaporator coil in an indoor furnace cabinet.

2. Description of Related Art

Bifurcated, or "split" type, central air heating and cooling systems for private residences and small offices include an indoor unit with a cabinet housing an evaporator coil, blower and heating means such as a gas- or oil-burning heat exchanger or electric heater strips (said heating means hereinafter generally "furnace"). The indoor blower impels indoor air through the furnace, across the evaporator coil and into duct work for distribution within the structure. See FIG. 1. An outdoor unit includes a cabinet housing a compressor, condenser coil and fan, the outdoor unit usually sitting on a pad adjacent a building wall. Refrigerant lines carry pressurized refrigerant between the indoor and outdoor components. The fan blows outdoor air across the condenser coil to expel heat from the refrigerant, while the compressor repressurizes the refrigerant for cycling back to the evaporator. Heat pump systems supplement the furnace by reversing this process, drawing heat from outdoors and expelling it into the indoor space, but otherwise function similarly.

A typical evaporator consists of a series of fin-and-tube coil layers formed into one or more substantially planar slabs. Evaporators come in several types known by descriptive terms, such as "Slant coil" (one slab, often mounted at an angle to the air flow; FIG. 1), "A-coil" (two slabs mated at one edge into an "A" shape), "N-coil (three slabs) or "Pleated- or Multi-coil" (4 or more slabs) evaporators. In any case, the evaporator presents a cross section to the indoor air flow appropriately sized for the space to be cooled. Fins along the tubing encourage heat in the air to flow into the evaporator. NOTE: the terms "evaporator" and "evaporator coil" are used interchangeably herein to refer to the indoor structure which absorbs heat from indoor air in an air conditioning system.

Interior space in such small structures, and especially in mobile homes, can be comparatively scarce. Small structures often don't include attic space, so the indoor equipment typically is housed together within a furnace cabinet enclosed in a dedicated indoor closet or alcove. The cabinet often fills the closet or alcove, and access to service the equipment is inconvenient at best and sometimes limited to the cabinet front, such as through a front panel behind a closet door.

Service to such indoor equipment often requires replacement of the evaporator, such as when it is old and worn out.

Furnaces, by contrast, often last longer, so the cabinet housing both the furnace and evaporator may be retained. Replacement evaporator coils may or may not mate with existing mounting hardware, however, and sometimes service personnel prefer other evaporator coils they perceive as superior to or less expensive than what was originally installed. This often leads to replacing, e.g., a slant style evaporator coil with an A-coil. A need exists for ready mounting hardware for doing so.

SUMMARY OF THE INVENTION

A universal shelf for mounting an evaporator coil into an indoor furnace cabinet includes a planar platform substantially the size of the cross section of the furnace cabinet and having attachment means along its edges, which, in one embodiment, mate with existing mounting hardware for different types of evaporator coils. At least one edge of the platform includes a rectangular step extending at least a portion of the length of the platform, the shelf adapted to mate with a U-shaped rail attachable to the inside of the cabinet. A foldable tab on the front edge of the shelf opposite the rail attaches to the front of the cabinet while, in a preferred embodiment, a leg hingedly attached to the rear corner of the shelf opposite the rail rests upon the floor of the cabinet to hold the platform level with the rail.

BRIEF DESCRIPTION OF THE DRAWINGS

The novel features believed characteristic of the present invention may be set forth in appended claims. The invention itself, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
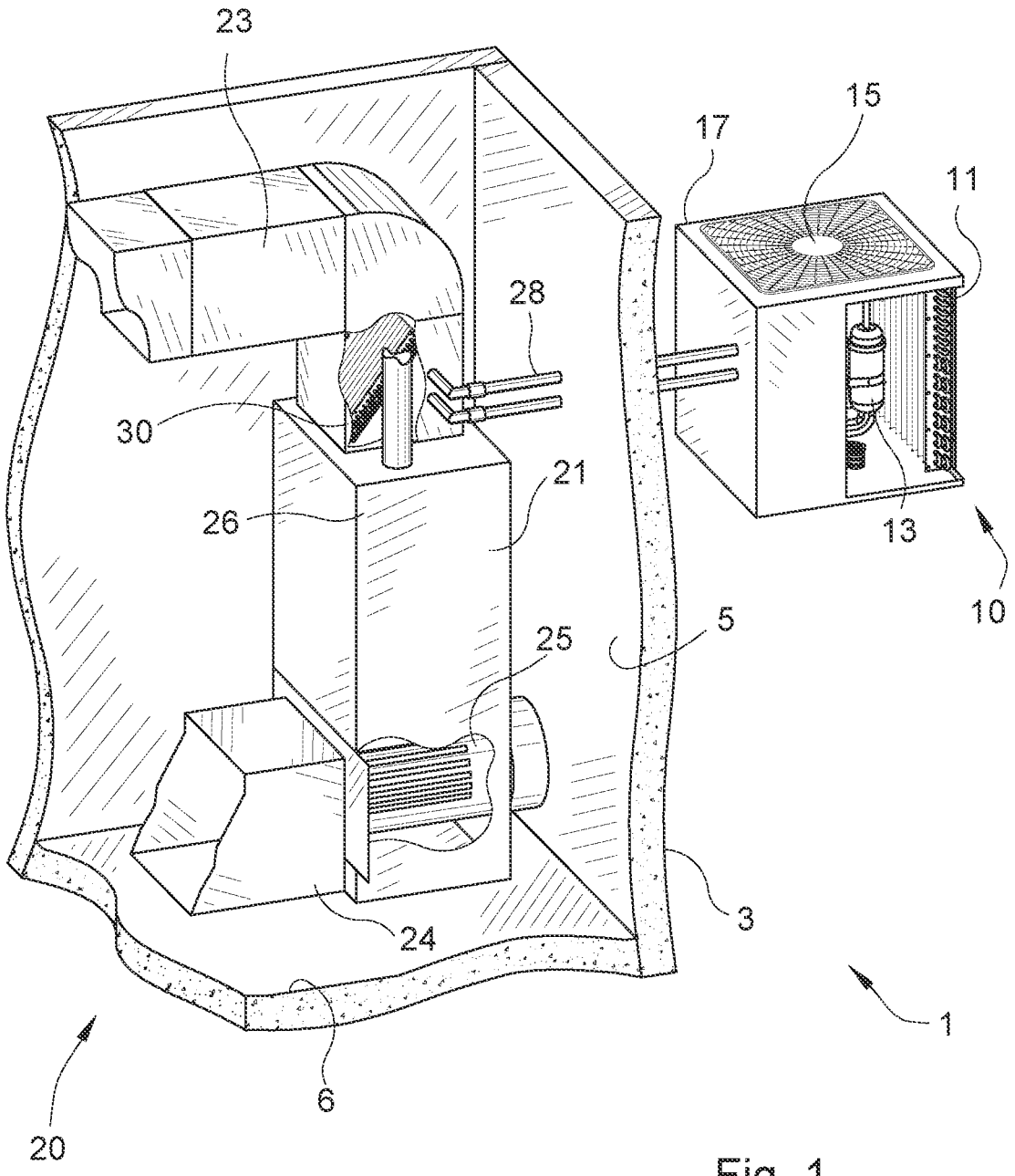
FIG. 1 depicts in schematic a typical bifurcated air conditioning and heating system.

Referring now to the figures, and particularly to FIGS. 1-3A, bifurcated air conditioning system 1 includes outdoor unit 10 having condenser coil 11, compressor 13 and fan 15 contained within housing 17. Outdoor unit 10 preferably sits adjacent building structure 3 and couples to indoor unit 20 through refrigerant lines 28. Outdoor unit 10 removes heat from heat-laden refrigerant by means of fan 15 blowing outside air across condenser coil 11, while compressor 13 pressurizes the cooled refrigerant for return to indoor unit 20.

Figure 2:
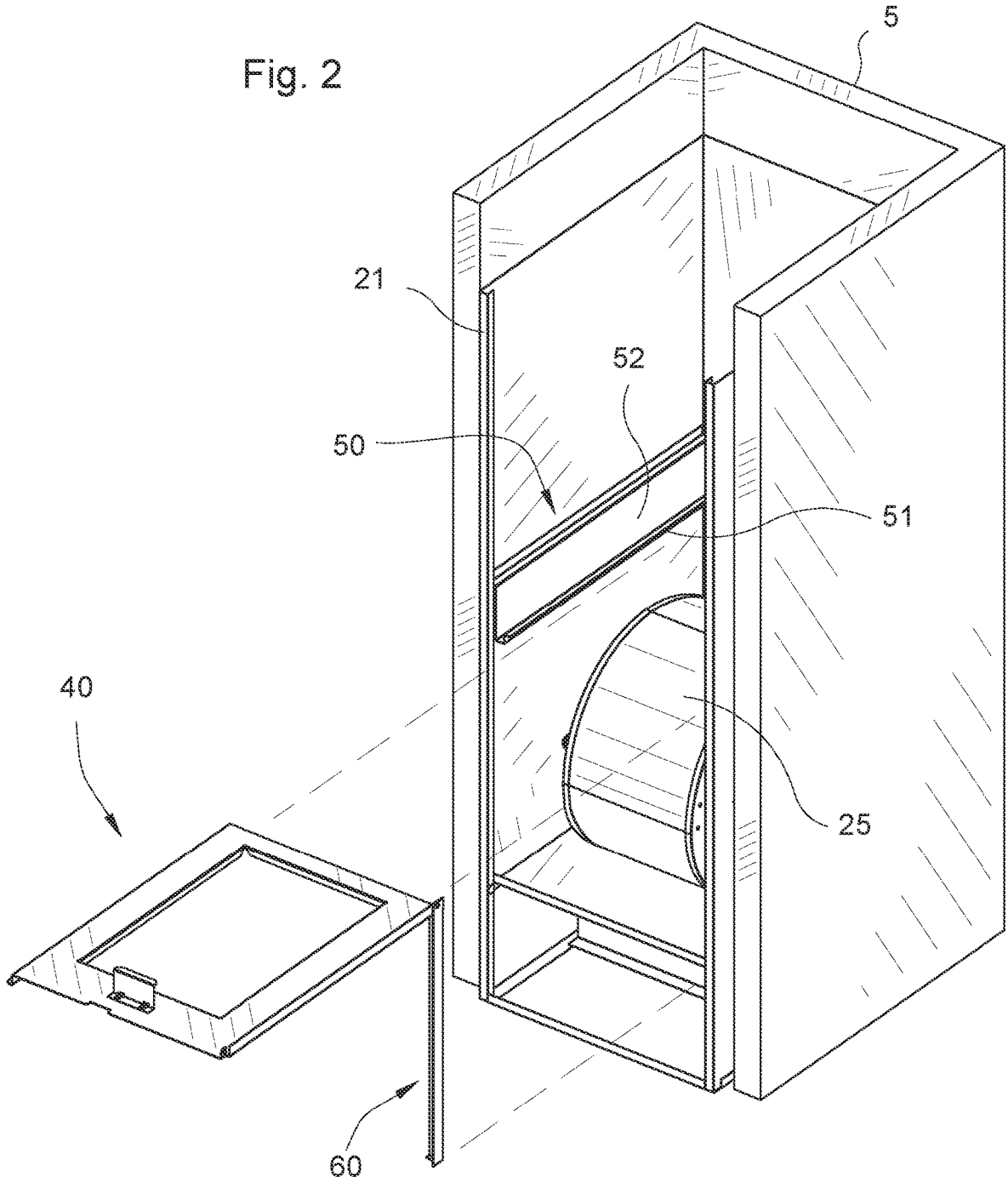
FIG. 2 is a quartering perspective of a mobile home variation on the bifurcated system of FIG. 1 with a particular embodiment of the present invention poised to be installed within the furnace cabinet.

Indoor unit 20 comprises, as depicted, vertically disposed cabinet 21 coupled between intake air duct 23 and outlet duct 24. Cabinet 21 preferably is substantially rectangular in horizontal cross section and defined by left, right, front and rear walls surrounding interior evaporator chamber 27. Cabinet 21 typically is disposed in a dedicated space, commonly a closet 5 (FIGS. 2-3A), alcove, attic (neither shown) or basement (FIG. 1), preferably centrally located within structure 3 to minimize the length of outlet ducts 24. As best seen in FIGS. 2, 3, such dedicated closet 5 commonly is substantially filled by cabinet 21, leaving very little if any space outside cabinet 21 for access by service personnel (not shown).

Disposed within interior 27 of cabinet 21, blower 25 impels indoor air AI from intake duct 23 through cabinet 21 and out AO through outlet duct 24 for distribution throughout structure 3. One having ordinary skill in the art will recognize that blower 25 may be disposed anywhere within cabinet 21 across the path of the indoor air as it flows between intake duct 23 and outlet duct 24. Also disposed across the path of indoor air AI, evaporator coil 30 cools indoor air AI by absorbing heat from the air into the refrigerant as it flows through lines 28.

Cabinet 21 further typically encloses heating means in the form of furnace 26 also disposed across the path of indoor air AI. Furnace 26 operates independently of air conditioning system 1 but typically shares a common controller (not shown) which determines whether heating or cooling is being done, and sets the target indoor temperature for both. One having ordinary skill in the art will appreciate also that cabinet 21 commonly is installed containing only furnace 26, the initial installation thereof contemplating either no need for, or later addition of, evaporator 30 of air conditioning system 1. Cabinet 21 typically includes space for evaporator coil 30 in such circumstances, whether or not it initially is included.

Figure 3A:
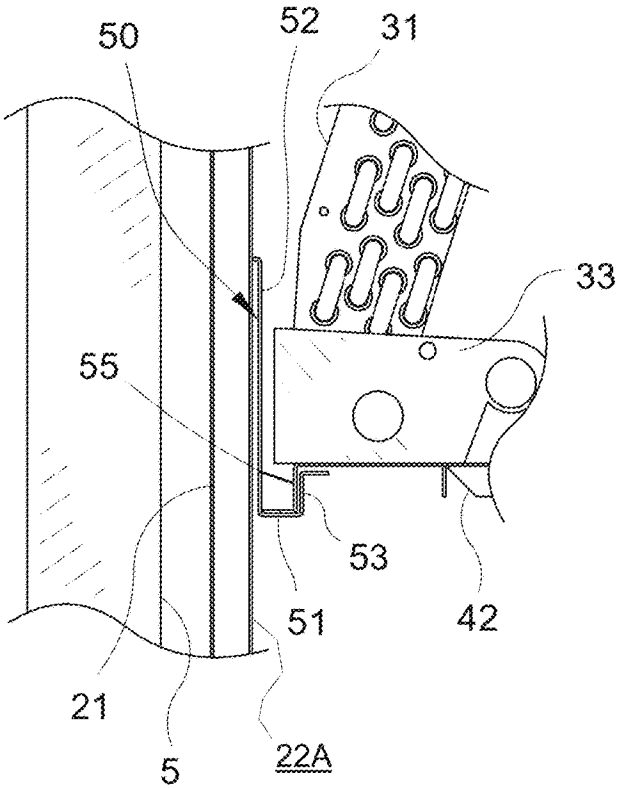
FIG. 3A details a step on one edge of the present invention where it mates to a rail on the inside of the cabinet of FIG. 3.
Figure 3:
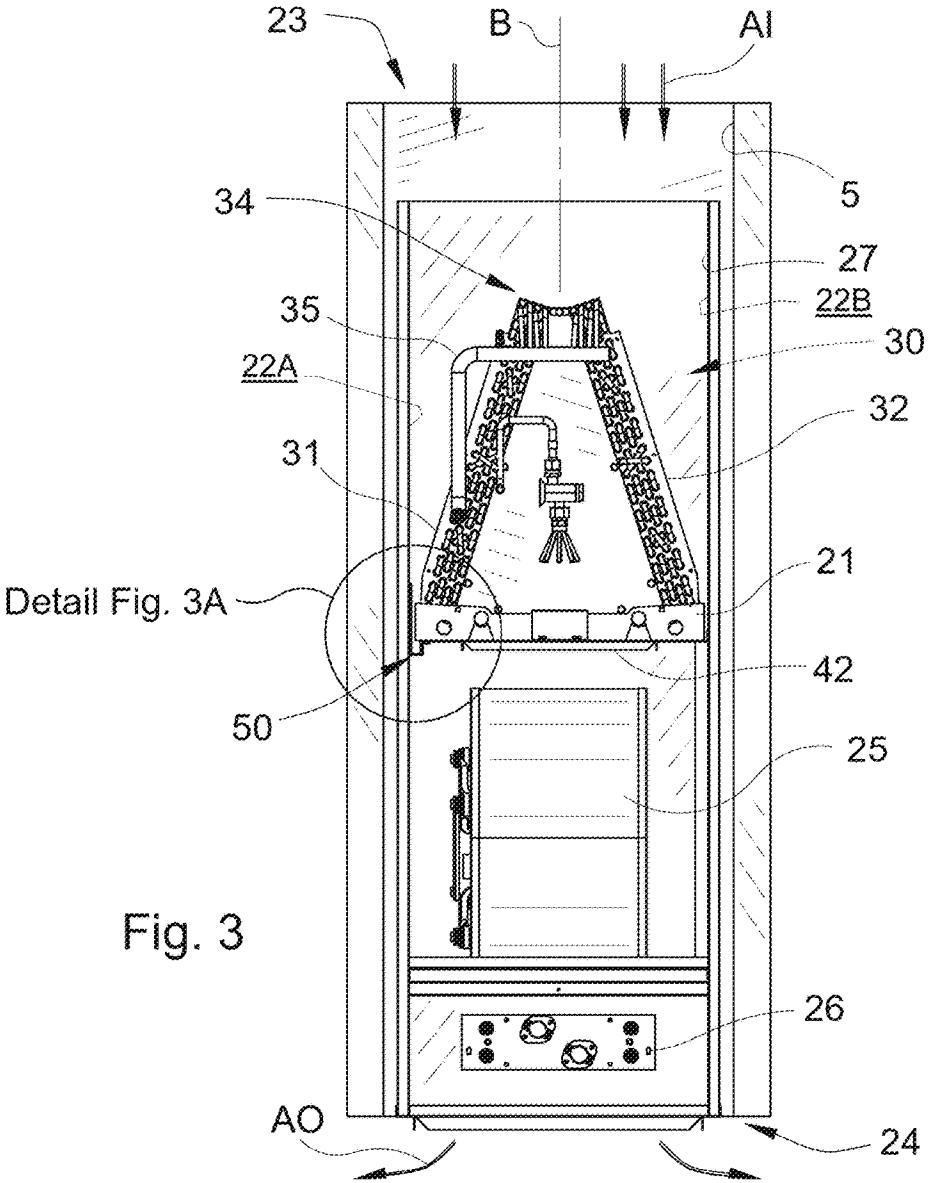
FIG. 3 depicts a front elevational view of the cabinet of FIG. 2 housed within a closet and containing a furnace, blower and A-coil evaporator.

As best seen in FIGS. 3, 3A, evaporator 30 preferably used with the present invention comprises an A-shaped structure having horizontal base 33 surmounted by and supporting substantially flat fin-and-tube coil slabs 31, 32 disposed at opposite angles to, but typically symmetric about, vertical axis B of cabinet 21. Coil slabs 31, 32 meet at apex 34 where their internal tube coils are coupled together to provide a continuous flow path for the pressurized refrigerant coming from outdoor unit 10.

Base 33 surrounds an air-flow aperture (not shown) through which indoor air is channeled across the surfaces of slabs 31, 32. As indicated by double arrows in FIG. 3, air AI impelled by blower 25 is drawn downward from inlet 23, across slabs 31, 32 and out of evaporator 30 through evaporator A-coil aperture (not shown) in base 33. Entering blower 25, indoor air AI then flows downward across electric furnace 26 and out of cabinet 21 through outlet duct 24. Base 33 also typically doubles as a drain pan adapted to collect and channel away moisture condensing from indoor air AI onto coil slabs 31, 32.

Figure 4:
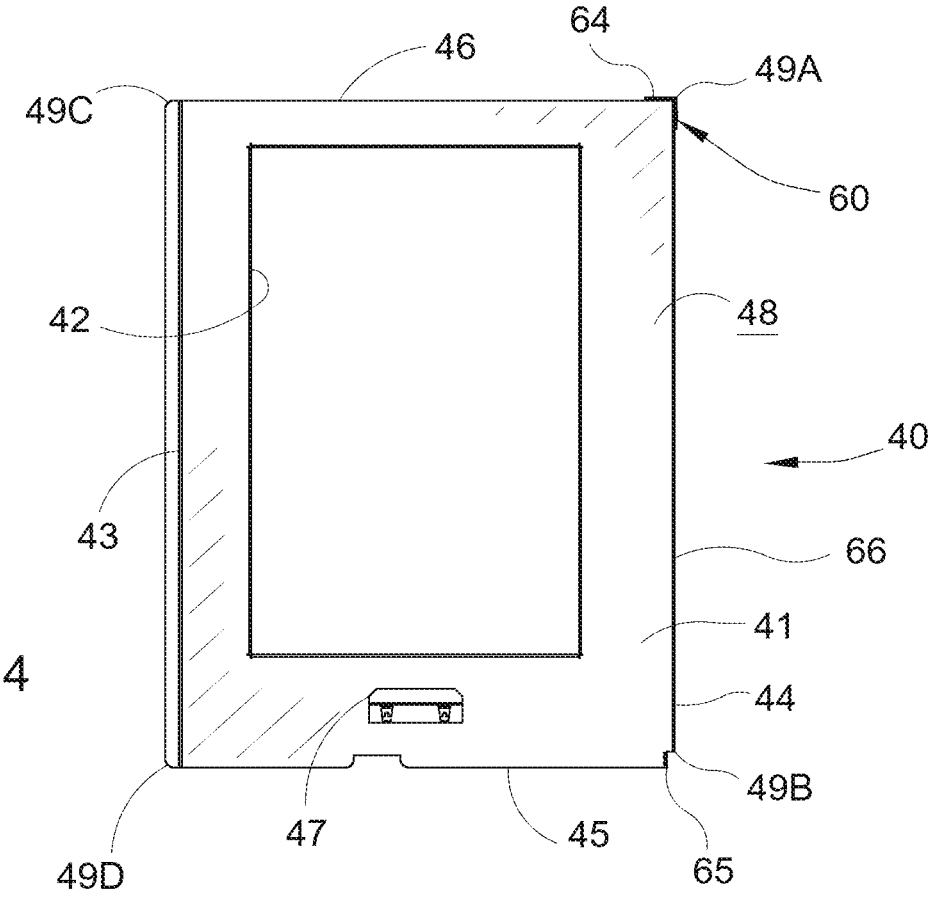
FIGS. 4 and 5 are top plan and front elevational (as seen from the front of the furnace cabinet of FIG. 2) views, respectively, of the particular embodiment of FIGS. 2-3A.
Figure 5:
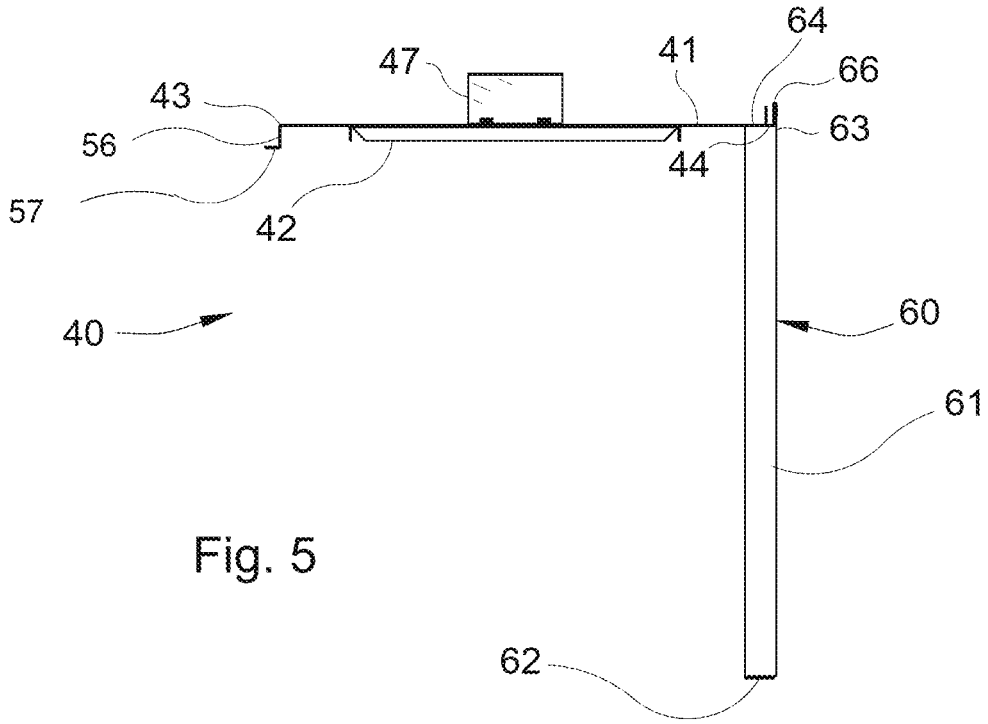

As best seen in FIG. 2 and detailed in FIGS. 4, 5, shelf 40 is adapted to be inserted into cabinet 21 to support evaporator coil 30 in sequence with blower 25. Shelf 40 comprises platform 41 having parallel, longitudinal, left and right side platform edges 43, 44, respectively, and parallel, transverse front and back platform edges 45, 46. As illustrated and described, platform 41 forms a rectangular perimeter sized and shaped congruently with the interior, horizontal cross section of cabinet 21. One having ordinary skill in the art will recognize that platform 41 can have any other perimeter shape as long as it fits snugly within cabinet 21 so that air flow from blower 25 passes through aperture 42 instead of around platform 41 along the interior sides of cabinet 21. Evaporator base clamp 47 disposed adjacent front edge 45 secures evaporator 30 in place atop shelf 40 to deter movement and vibration thereof during operation.

Platform 41 surrounds and defines platform air flow aperture 42 surrounded by evaporator support ledge 48. One having ordinary skill in the art will recognize that evaporator support ledge 48 is only as wide as necessary to support evaporator coil base 33, leaving a maximum air flow path through platform 41 substantially the size of the A-coil aperture (not shown, but discussed above) in base 33. Thus, shelf 40 is sized and positioned to optimize the air flow through blower 25.

Shelf 40 may be supported within cabinet 21 by any number of support means. As depicted in FIGS. 3, 3A, rail 50, disposed along the left interior side (as viewed from front edge 45 of shelf 40) of cabinet 21, includes substantially planar flange 52 attached to interior left side 22A of cabinet 21 by a plurality of sheet metal screws (not shown). Preferably, flange 52 extends for its flange length along left side 22A substantially the entire width of left side 22A from the front to the rear of cabinet 21.

One having ordinary skill in the art will appreciate that some cabinets 21 already will have rail 50 installed on one of left or right interior sides 22A, 22B of interior 27 of cabinet 21. This occurs, for example, when cabinet 21 originally comes with a slant-style (see FIG. 1) evaporator coil already installed and supported at its bottom edge by rail 50, but which must be replaced by A-coil 30. This could occur, for example, if the original equipment slant-style evaporator coil is defective or worn out, or when compressor 13 fails and needs replacing (it is common to replace evaporator coil 30 when replacing compressor 13 or outdoor unit 10).

Thus, once cabinet 21 is installed within closet 5, rail 50 may not be removed easily, as, at least in the case of a retro-fit or replacement of previously installed coil 30 (e.g., FIG. 1), sheet metal screws (not shown) holding previously installed rail 50 to one of cabinet side walls 22A, 22B very likely were inserted from the outside of cabinet 21. One of the advantages of the present invention is that it may utilize such previously installed rail 50 without requiring its removal. In other cases, such as discussed below for another particular embodiment of the invention using two rails 50, 150, or where rail 50 is not previously installed, one having ordinary skill in the art will recognize that such screws may be inserted and tightened from within interior 27 of cabinet 21 without needing access to the outside of cabinet 21.

Disposed along the bottom flange edge (as installed) of rail 50, a ledge provides means for supporting shelf 40 on rail 50. In one embodiment, the ledge comprises trough 51 preferably extending the length of rail 50 from the front to the rear of cabinet 21 along cabinet side walls 22A, 22B. Trough 51 preferably is integral with the bottom edge of flange 52 and extends normal thereto into interior 27 of cabinet 21 a short distance to form said ledge, then upward a comparable distance to form lip 53. One having ordinary skill in the art will recognize that trough 51 thus preferably forms a channel opening upward and having a substantially rectangular cross section. More preferably, the channel formed by trough 51 is square in cross section, but one having ordinary skill in the art will appreciate that it could be U-shaped, V-shaped, have other cross sectional shapes, or even be simply a flat, horizontal ledge, without departing from the scope of the present invention.

Disposed on the bottom of shelf platform 41 at left edge 43, step 55 is sized and shaped to mate snugly within trough 51 and to support shelf 40 along the length of rail 50. As depicted, step 55 further includes descending leg portion 56 coupled by its upper leg edge to one of platform left and right side edges 43, 44 and descending to terminate at its bottom leg edge in substantially horizontally extending footer portion 57 disposed a spaced distance below and preferably parallel to the plane of platform 41. Preferably, the horizontal length of step 55 is co-extensive with the length of left or right side edges 43, 44, step 55 doubling as stiffener means along one side of platform 41 for reinforcing platform 41 against the weight of coil 30. One having ordinary skill in the art will recognize, however, that step 55 could comprise a series of two or more shorter length step portions 55 preferably evenly distributed along the length of platform side edges 43, 44.

By such means, shelf 40 secures at its left edge to rail 50 on the left side of the interior of cabinet 21, rendering the interface between cabinet 21 and shelf 40 substantially air tight. One having ordinary skill in the art will recognize that the size and shape of step 55 varies according to the shape of trough 51, as discussed above. The important parameters are that trough 51 and step 55 are sufficiently long and strong enough to support the weight of evaporator coil 30 and to deter shelf 40 from moving relative to the left side of cabinet 21, and that shelf 40 mates snugly with the interior sides of cabinet 21 so indoor air AI flows only through aperture 42.

Figure 6:
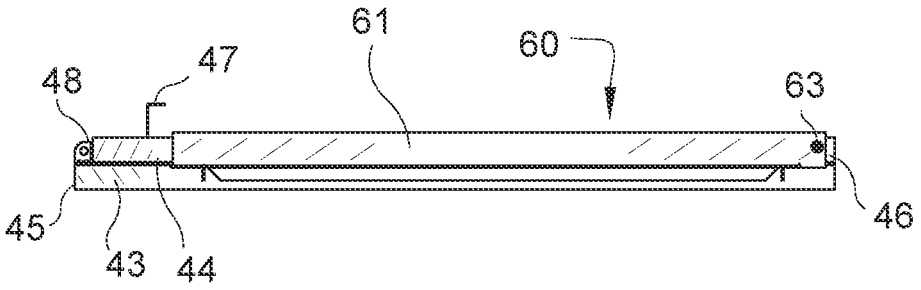
FIGS. 6, 7 are side elevational views of the embodiment of FIGS. 2-3A having its support leg folded for transportation and storage (FIG. 6) and in stages of extension to its vertical, installed position (FIG. 7).
Figure 7:
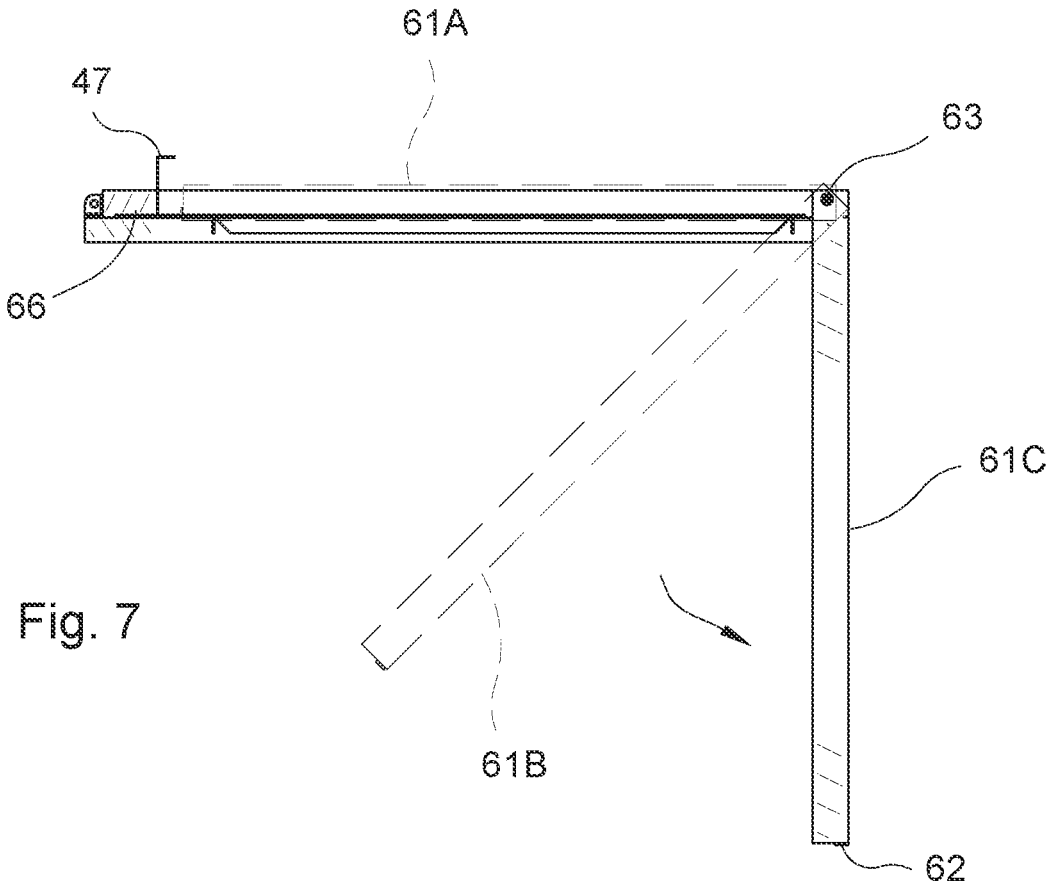

Turning now also to FIGS. 6-7, means may be provided for supporting right side 44 of shelf 40 opposite step 55 to the right interior side of cabinet 21. In a particular embodiment, vertically disposed stiffener 66 extends upwards a short distance normal to platform 41 along edge 44, thereby reinforcing platform 41 against the weight of coil 30 on the opposite side of platform 41 from step 55. Support legs 60, 160 (discussed alternatively below) couple to right, rear corner 49A (at the intersection of right side 44 and rear edge 46) and support right rear corner 49A of shelf 40 opposite rail 50. Disposed at front right corner 49B (at the intersection of front edge 45 and right side 44) of platform 41, tab 65 serves as attachment means for attaching front right corner 49B of shelf 40 to cabinet 21, and for supporting right front corner 49B opposite rail 50, using conventional attachment means such as a sheet metal screw (not shown). Thus, once rail 50 is in place along the left interior side of cabinet 21 (as described above), installation of shelf 40 quickly follows by simply resting it on leg 60 and inserting one sheet metal screw through tab 65 and into cabinet 21.

Figure 12A:
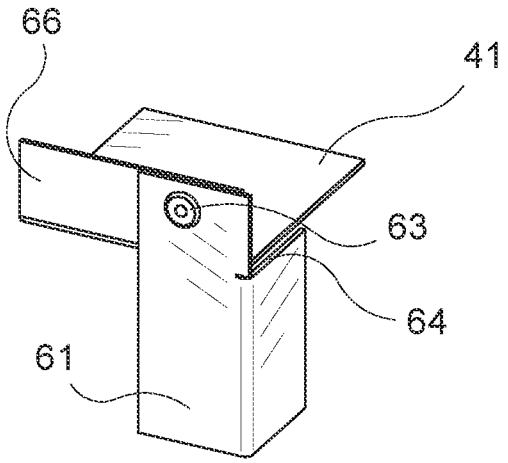
FIGS. 12A, 12B detail a hinged leg attachment to the platform of FIGS. 6, 7.
Figure 12B:
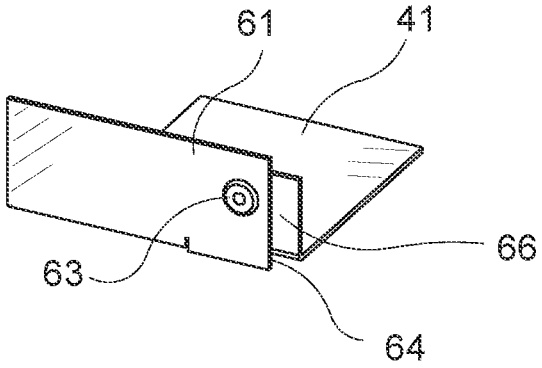
Figure 13:
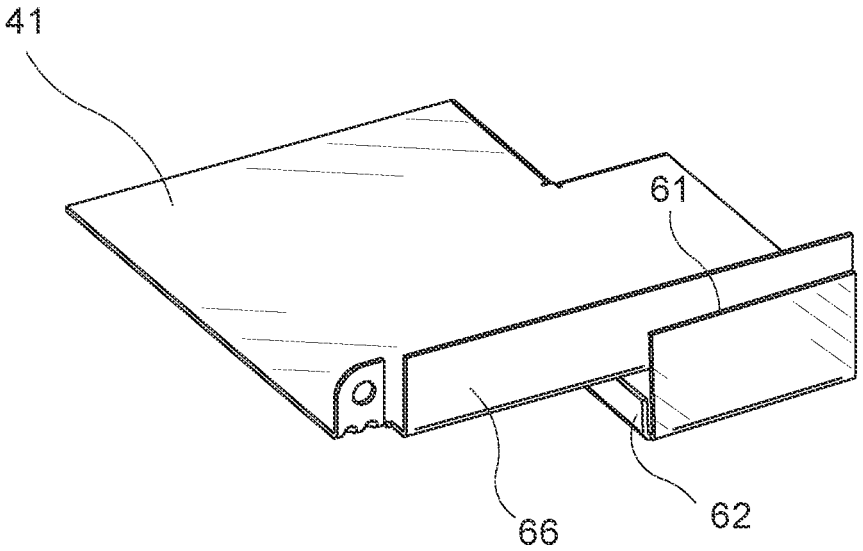
FIG. 13 details the lower end of the support leg where it rests for transportation.

As best seen in FIGS. 6, 7, leg mast 61 of leg 60 attaches by hinge means 63 at right rear corner 49A of platform 41. In a preferred embodiment, hinge means 63 comprises a pivot pin coupling leg 60 to the end of stiffener 66 at corner 49A. Hinge means 63 also may include hinge stop 64 (see also FIGS. 5, 12A, 12B) which abuts rear edge 46 at corner 49A when leg mast 61 is extended into its vertical position (position 61C in FIG. 7), thereby holding leg 60 in its extended, vertical position while the installer (not shown) inserts shelf 40 into cabinet 21. Advantageously, the installer thus need not attach leg 60 during installation. Instead, leg 60, already having been attached during manufacture and transported lying along right edge 44 (position 61A in FIG. 7; see also FIG. 13) adjacent stiffener 66, easily can be extended during installation, thereby conserving installation time.

Figure 8:
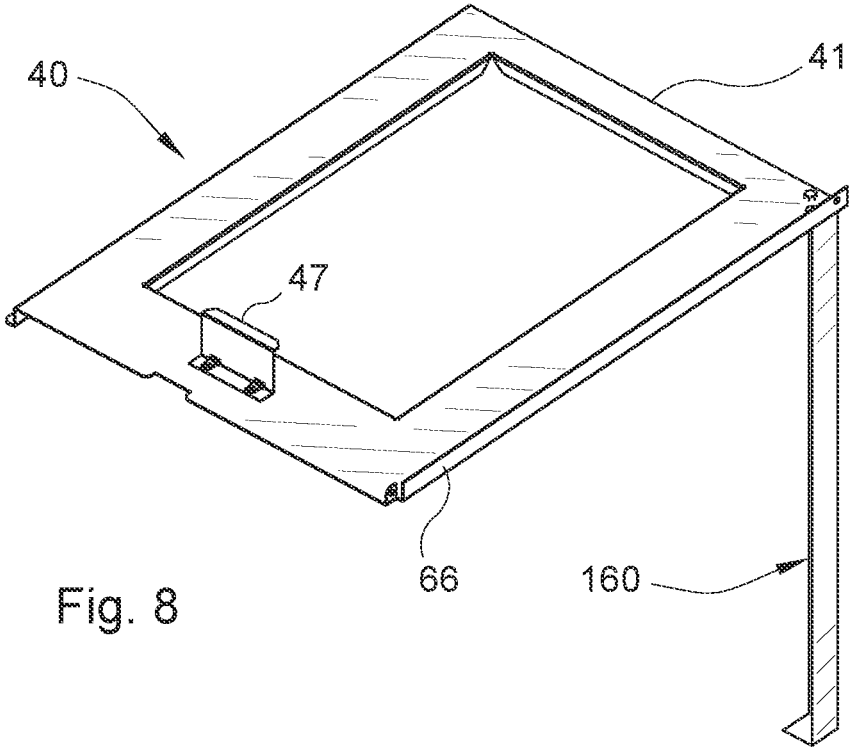
FIGS. 8, 9 show in perspective and front elevational views, respectively, another particular embodiment of the leg of FIGS. 2-7.
Figure 9:
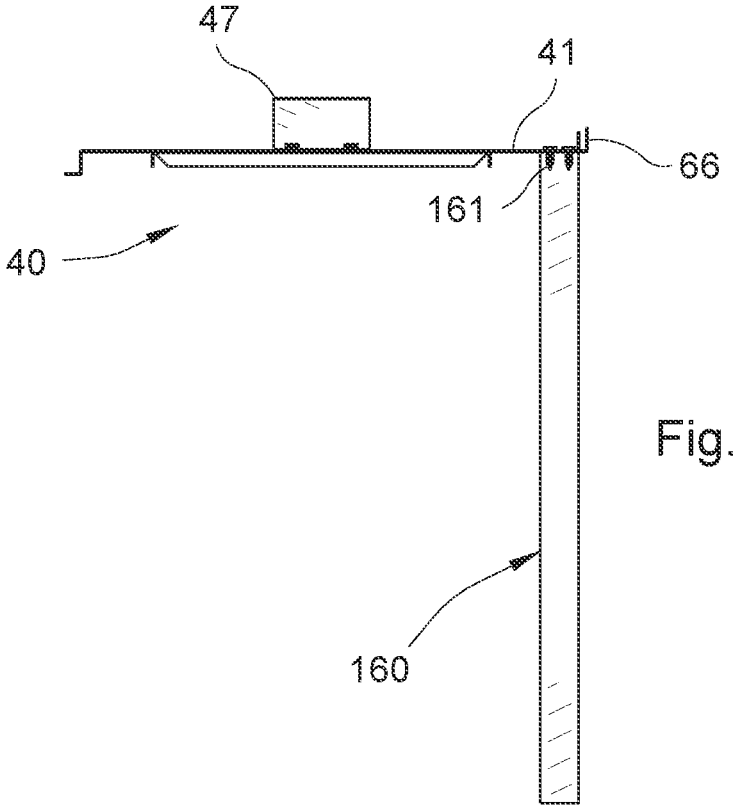

Turning now also to FIGS. 8, 9, alternate leg 160 may replace leg 60. Unlike leg 60, leg 160 preferably has not been attached during manufacture, nor does it hinge on stiffener 66 as described above for leg 60. Instead, leg 160 is provided with shelf 40 for attachment by the installer. Leg 160 includes horizontal flange (not shown) which abuts the bottom of platform 41 and is adapted to be affixed to platform 41 by the installer using a plurality of fasteners such as sheet metal screws 161. Advantageously, this embodiment thereby eliminates hinge means 63 and lowers manufacturing costs. One having ordinary skill in the art will recognize that other leg attachments, such as a conventional barrel and pin style hinge, could be employed, whether affixed during manufacturing or installation, without departing from the scope of the present invention.

Figure 10:
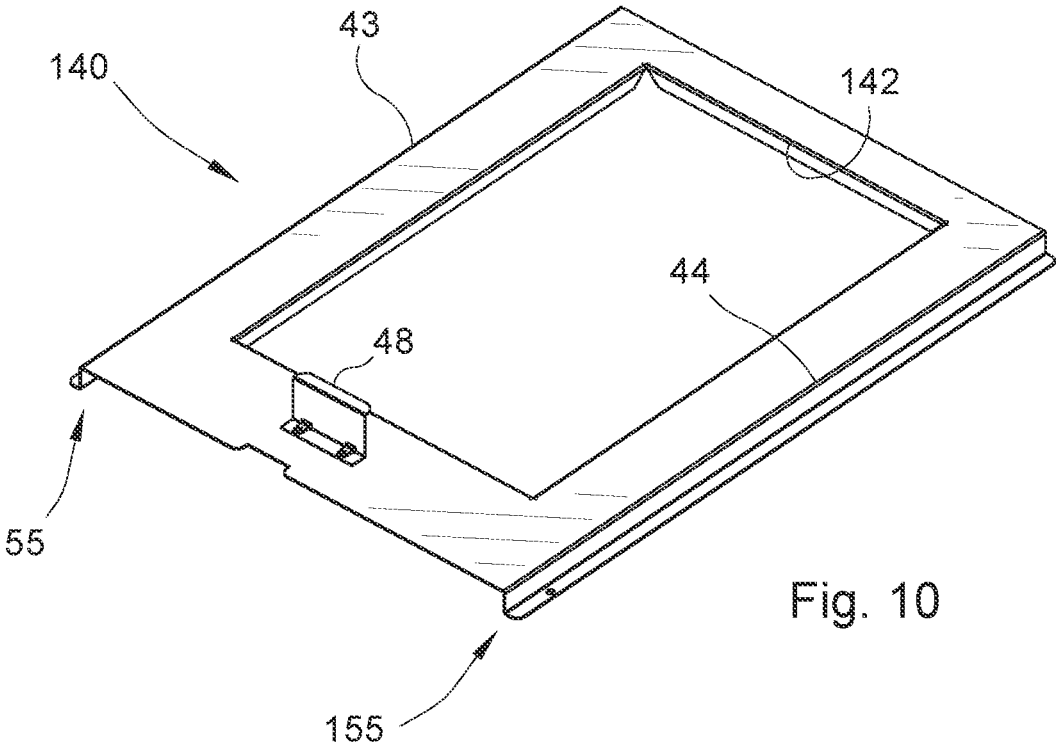
FIGS. 10, 11 depict in perspective and front elevational views, respectively, another particular embodiment of the present invention comprising a shelf having two steps on opposite side edges, with corresponding support rails attached to both interior sides of the cabinet.
Figure 11:
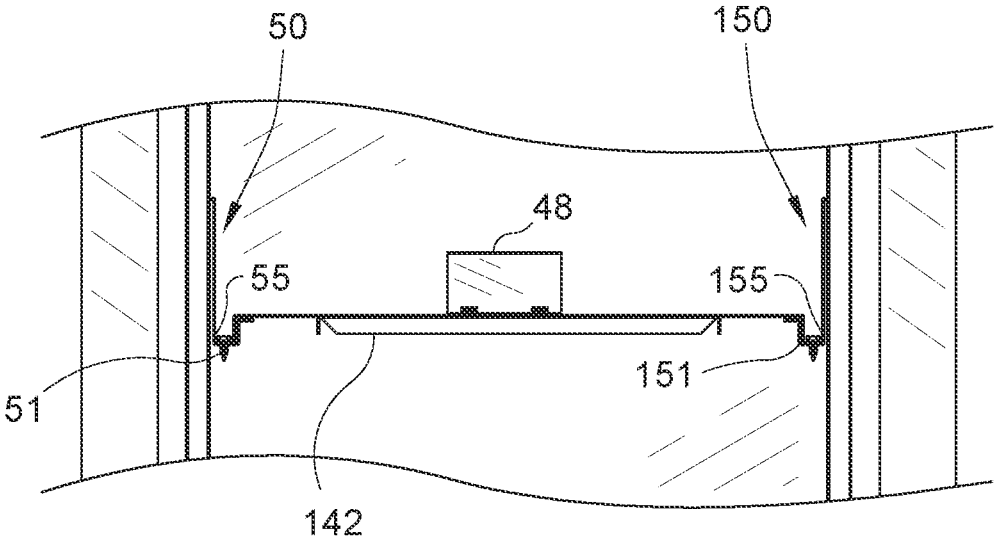

Turning now also to FIGS. 10, 11, another particular embodiment of the present invention comprises shelf 140 bearing, in addition to first step 55 disposed along left edge 43, second step 155 disposed similarly along right edge 44 of platform 141. Step 155 replaces stiffener 66 as stiffener means for right side 44 similarly to step 55, as discussed above. Second rail 150 (FIG. 11), in concert with second step 155, also obviates the need for legs 60, 160. Shelf 140 thereby is supported at its right edge 44 by second rail 150 and trough 151 similarly attached as described for rail 50 to the right interior side of cabinet 21. In this particular embodiment, tab 65 optionally still may be included as means for horizontally and firmly affixing shelf 140 in place, but one having ordinary skill in the art will recognize that it is not mandatory for satisfactory functioning of shelf 140.

In operation, the installer (not shown) inspects cabinet 21 to see if rail 50 already is in place. Assuming not for this discussion, the installer secures rail 50 to one side (the left interior side as discussed herein) of cabinet 21, making sure that it is horizontally level. Alternately, of course, if rail 50 is already in place, the installer may skip this step. In either case, the installer next retrieves shelf 40, mates step 55 within trough 51, and extends leg 60 from position C to position D as shown in FIG. 7. If shelf 40 did not come with leg 60 attached, but instead contemplates use of leg 160, then the installer first attaches leg 160 as discussed above. In either case, the installer then rests leg 60 or 160 onto floor 6 or other resting surface (not shown) within cabinet 21, levels right side 44 and secures front corner 49B of shelf 40 to cabinet 21 using tab 65.

Alternately, the installer selects shelf 140 and second rail 150, securing the latter to the right interior side of cabinet 21 as described above for rail 50. The installer then simply rests shelf 140 on rails 50, 150 simultaneously and secures them with sheet metal screws (FIG. 11).

In either case, the installer then slides A-coil evaporator onto shelf 40/140 with its base aperture aligned with aperture 42/142 and secures it to ledge 48/148 using clamp 47. The installer then proceeds to connect tubing 28 and to charge system 1 with refrigerant.

While the invention has been particularly shown and described with reference to one or more particular embodiments, it will be understood by those skilled in the art that various changes in form and detail may be made therein without departing from the spirit and scope of the invention. For example, rail 50 has been described above as positioned on the left side of the interior of cabinet 21, but it could instead be on the right side. Shelf 40 thus has been described as having its leg support on the right rear corner 49A, but it could be on the left rear corner 49C. Legs 60, 160 also could come hingedly attach to one of said rear corners 49A, 49C, depending upon to which side of cabinet 21 rail 50 is attached, but easily could be moved by the installer to the opposite rear corner. Further, legs 60, 160 also could include telescoping means (not shown) such as selectable holes in masts 61, 161 adapted to be overlapped and affixed in a plurality of alternative positions with fasteners such as bolts (not shown) for adjusting the lengths of masts 61, 161 to match the height within cabinet 21 of installed rail 50. In such case, the installation operation above would include the further steps of measuring the required length of masts 61, 161 and then adjusting their length using such telescoping means.

I claim:

1. A shelf system for an air conditioner evaporator, the evaporator adapted to be installed within a cabinet having cabinet side walls surrounding and defining a cabinet cross section and an evaporator chamber adapted to receive said evaporator, the shelf system comprising a platform having a platform perimeter substantially congruent with said cabinet cross section and defined by platform front, back and side edges, said platform further surrounding and defining a platform air flow aperture;

a first shelf step depending from one of said platform side edges, a first rail disposed on a first cabinet side wall, said first rail having a first ledge adapted to receive and support said first shelf step; and a support leg disposed on said platform opposite said first shelf step, said support leg having a vertical mast having a mast top end coupled to said platform and a mast bottom end, said mast adapted to extend from said platform to a resting surface within said cabinet; and attachment means for attaching said mast to said platform.

2. The shelf system of claim 1 wherein said first shelf step includes a first shelf step cross section disposed normal to said one of said cabinet side walls; and said first ledge includes a first ledge cross section congruent with said first shelf step cross section.

3. The shelf system of claim 1 wherein said first shelf step further includes a leg portion disposed along a portion of said one of said platform side edges, said leg portion having a proximate leg edge coupled to said one of said platform side edges and a distal leg edge; and a footer portion disposed along said distal leg edge and extending toward one of said cabinet side walls;

and said first rail further includes a first flange disposed on said first cabinet side wall, said first flange having a first flange length and first flange edges disposed on opposite sides of said first flange length; and said first ledge extends from one of said first flange edges away from said first cabinet side wall to terminate in a first lip.

4. The shelf system of claim 1 and further comprising a tab disposed on said platform opposite said first shelf step and said support leg, said tab adapted to be affixed to said cabinet.

5. The shelf system of claim 1 and wherein said attachment means comprises hinge means coupled to said mast top end and adapted hingedly to couple said mast to said platform, whereby said support leg articulates between a storage position disposed along one of said platform edges and an installation position disposed normal to said platform.

6. The shelf system of claim 5 and further comprising hinge stop means disposed on said mast top end adjacent said platform for stopping extension of said mast beyond said installation position.

7. The shelf system of claim 1 and further comprising a second shelf step disposed on said platform along a second one of said platform side edges opposite said first shelf step; and a second rail disposed on a second side cabinet wall opposite said first side cabinet wall, said second rail having a second ledge adapted to receive and support said second shelf step.

8. The shelf system of claim 7 wherein said second shelf step includes a second shelf step cross section disposed normal to said second cabinet side wall; and said second ledge includes a second ledge cross section congruent with said second shelf step cross section.

9. The shelf system of claim 7 wherein said second shelf step further includes a second leg portion disposed along a portion of said second one of said platform side edges, said second leg portion having a proximate second leg edge coupled to said second one of said platform side edges and a distal second leg edge; and a second footer portion disposed along said distal second leg edge and extending toward said second one of said cabinet side wall;

and said second rail further includes a second flange disposed on said second cabinet side wall, said second flange having a second flange length and second flange edges disposed on opposite sides of said second flange length; and said second ledge extends from one of said second flange edges away from said second cabinet side wall to terminate in a second lip.

10. A shelf system for an air conditioner evaporator, the evaporator adapted to be installed within a cabinet having a cross section defined by cabinet walls, said cabinet walls further defining a cabinet cross section and an evaporator chamber adapted to receive said evaporator, the shelf system comprising a platform having a platform perimeter substantially congruent with said cabinet cross section and defined by platform front, back and side edges, said platform further surrounding and defining a platform air flow aperture;

a first shelf step depending downward from one of said platform side edges, said first shelf step having a descending leg portion disposed along a portion of said one of said platform side edges, said descending leg portion having an upper edge proximate said one of said platform side edges and a distal bottom edge; and a footer portion disposed along said bottom edge and extending toward one of said cabinet side walls;

a first rail disposed on a first side cabinet wall, said first rail having a flange disposed horizontally on said first side cabinet wall, said flange having a flange length and top and bottom flange edges;

an upwardly opening ledge disposed substantially parallel to said bottom flange edge a select portion of said flange length, said ledge extending from said flange away from said first side cabinet wall to terminate in an upwardly extending lip, whereby said ledge is adapted to receive and support said shelf step; and a support leg disposed on said platform opposite said first shelf step, said support leg having a vertical mast having a mast top end coupled to said platform and a mast bottom end, said mast adapted to extend from said platform to a resting surface within said cabinet; and hinge means coupled to said mast top end and adapted hingedly to couple said mast to said platform, whereby said support leg articulates between a storage position disposed along one of said platform edges and an installation position disposed normal to said platform.

11. The shelf system of claim 10 and further comprising hinge stop means disposed on said mast top end adjacent said platform for stopping extension of said mast beyond said installation position.

12. The shelf system of claim 10 and further comprising a second shelf step disposed on said platform along a second one of said platform side edges opposite said first shelf step; and a second rail disposed on a second side cabinet wall opposite said first side cabinet wall, said second rail having a second flange disposed horizontally on said second side cabinet wall, said second flange having a second flange length and top and bottom second flange edges;

an upwardly opening second ledge disposed substantially parallel to said bottom second flange edge a select portion of said second flange length, said second ledge extending from said second flange away from said second side cabinet wall to terminate in an upwardly extending second lip, whereby said second ledge is adapted to receive and support said second shelf step.

13. A method of installing a shelf support system for an air conditioner evaporator into an indoor air conditioner cabinet, the cabinet having an evaporator chamber adapted to receive said evaporator, said evaporator chamber having a horizontal cross section defined by vertical cabinet side walls, the method comprising providing an evaporator shelf having a platform having a platform perimeter substantially congruent with said cabinet horizontal cross section and defined by platform front, back and side edges, said platform further surrounding and defining a platform air flow aperture;

a first shelf step depending from one of said platform side edges; and a support leg adapted to couple to said platform opposite said first shelf step, said support leg having an installation position disposed normal to said platform; and securing means for securing said platform to a second one of said cabinet side walls;

; and providing a first rail adapted to be disposed on a first one of said cabinet side walls, said first rail having a first ledge disposed substantially parallel to and adapted to receive and support said first shelf step; then affixing said first rail to said first one of said cabinet side walls with said ledge extending away from said first one of said cabinet side walls; then installing said evaporator shelf into said evaporator chamber by placing said first shelf step onto said first ledge; then supporting said opposite one of said platform side edges by extending said support leg to said installation position; and then resting said support leg onto a resting surface within said cabinet; and securing said platform to said second one of cabinet said walls.

14. The method of claim 13 and further comprising a second shelf step disposed on said platform along a second one of said platform side edges opposite said first shelf step; and a second rail adapted to be disposed on a second one of said cabinet side walls opposite said first one of said cabinet side walls, said second rail having a second ledge normal to said second rail and extending away from said second one of said cabinet side walls, said second ledge adapted to receive and support said second shelf step; and said affixing step includes affixing said second rail to said second one of said cabinet side walls with said second ledge extending away from said second one of said cabinet side walls; and said supporting step further includes placing said second shelf step onto said second ledge.

15. The method of claim 13 wherein said securing means comprises a tab disposed on said platform opposite said first shelf step and said support leg, said tab adapted to be affixed to one of said cabinet side walls.

* * * * *